US006745000B2

(12) United States Patent
Pirwitz

(10) Patent No.: US 6,745,000 B2
(45) Date of Patent: Jun. 1, 2004

(54) CRADLE FOR A FUSING ASSEMBLY

(75) Inventor: Robert G. Pirwitz, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 87 days.

(21) Appl. No.: 10/142,377

(22) Filed: May 9, 2002

(65) Prior Publication Data

US 2003/0210923 A1 Nov. 13, 2003

(51) Int. Cl.[7] ..... G03G 15/16
(52) U.S. Cl. ..... 399/122
(58) Field of Search ..... 399/107, 110, 399/122, 320, 328, 330, 331; 219/216

(56) References Cited

U.S. PATENT DOCUMENTS

| | | | | |
|---|---|---|---|---|
| 4,782,359 A | * | 11/1988 | Tomoe | 399/122 |
| 5,848,331 A | | 12/1998 | Fromm | 399/122 |
| 6,002,913 A | | 12/1999 | Pawlik et al. | 399/406 |
| 6,253,046 B1 | * | 6/2001 | Horrall et al. | 399/124 |
| 6,265,694 B1 | | 7/2001 | Pirwitz | 219/216 |
| 6,269,230 B1 | * | 7/2001 | Kikuchi | 399/122 |

* cited by examiner

*Primary Examiner*—Hoan Tran
(74) *Attorney, Agent, or Firm*—Andrew D. Ryan

(57) ABSTRACT

A cradle for a fusing assembly including end tabs or protrusions for supporting and pivoting on a side wall. The cradle functionally associates with the side walls and is adapted to angularly pivot between a first position and a second position.

23 Claims, 7 Drawing Sheets

CRADLE FOR A FUSING ASSEMBLY

FIELD OF THE INVENTION

This invention relates generally to a fusing system in an electrophotographic printing machine, and more particularly to an improved system for supporting a roll in a fuser device.

BACKGROUND OF THE INVENTION

In an electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

While existing fuser frames and load arm systems are generally suitable, improvements in development quality and performance are desired. Existing systems may include pivot pins that are stacked, welded, or otherwise fastened to the side frame for mounting load arms in the fuser assemblies which must be tightly controlled to insure the strength and security of the pivot pin.

Reference is made to U.S. Pat. No. 5,848,331 relating to a fuser roll housing.

All documents cited herein, including the foregoing, are incorporated herein by reference in their entireties.

SUMMARY OF THE INVENTION

The principles described herein provide for a cradle system for use with a roll in an electrophotographic printing or copying system. This system utilizes a cradle and side frames including features formed therein to provide an assembly that allows the cradle to be supported and to pivot at pivot points while being supported on the side frames. This improved design eliminates the need for support pins, fastening issues and associated assembly costs. Support pins may apply generally high cantilever loads to fuser frames which under certain conditions may bend. This improved system generally eliminates cantilever loading of the fuser frames. A need exists for such an improved roll support system for printing and copying machines to resist high load between a roll pair, such as a pressure roll and fuser roll. An improved cost-effective cradle which eliminates cantilever loading of the fuser frames, parts, pins and associated manufacturing steps would be beneficial.

In accordance with one aspect of the invention, there is provided a roll support system in an electrophotographic apparatus including a member including a wall. The wall has a longitudinal length, a first end and a second end. A pair of roll support members are formed from the wall and extend a distance from the wall. The roll support members are spaced apart from one another. The wall includes a first protrusion defining the first end and a second protrusion defining the second end. At least one of the first and second protrusions include a notch at an edge. The notch is adapted for selective positioning of the member with respect to a frame. The pair of roll support members is adapted to support a roll and to pivot between a first position and a second position.

Pursuant to another aspect of the invention, there is provided a support system for a roll in at least one of a printing and copying apparatus including a frame and a cradle. The frame has a first side and a second side. Each of the first side and second side having a length, width and thickness. The first side and second side each having an opening of a first selected shape. The cradle has a length and width and includes a first protrusion and a second protrusion defining a first end and a second end. At least one of the first and second protrusions include an opening of a second selected shape that is positioned opposed to the side opening such that the cradle is supported at the first and second protrusions by the first side and the second side. The cradle is adapted to angularly move with respect to the frame.

Pursuant to a further aspect of the invention, there is provided an electrophotographic apparatus including a fuser roll, a pressure roll, a frame system, and a cradle. The pressure roll is associated with the fuser roll. The frame system supports the fuser roll and the pressure roll. The frame system includes a first side and second side. Each of the first side and second side have a length, width and thickness. The first side and second side each have an opening of a selected shape. The cradle supports the pressure roll between the first side and the second side of the frame system. The cradle includes a wall, a length and a width, and a first protrusion and a second protrusion defining a first end and a second end of the wall. At least one of the first and second protrusions include an opening of a selected shape. A plurality of pressure roll support members extend a distance from the wall. The openings of the first protrusion and the second protrusion are positioned downward and the openings of the first side and the second side are situated upward such that the first protrusion and the second protrusion are supported by the first side and the second side and wherein the cradle is adapted to angularly move with respect to the frame system.

Pursuant to another aspect of the invention, there is provided a roll support system in an electrophotographic apparatus including a member including a wall. The wall has a longitudinal length, a first end and a second end. A plurality of roll support members extend a distance from the wall. The plurality of roll support members are spaced apart from one another. The wall includes a first protrusion defining the first end and a second protrusion defining the second end. At least one of the first and second protrusions including a notch at an edge. The notch is adapted for selective positioning of the member with respect to a frame. The plurality of roll support members are adapted to support a roll and the member is adapted to pivot between a first position and a second position.

Pursuant to yet another aspect of the invention, there is provided a cradle including a wall having a longitudinal length, a first end, a second end, and an angle for purposes of support, rigidity, and strength. A pair of roll support members are formed from the wall and extend a distance from the wall. The roll support members are spaced apart from one another and are used to hold and support a roll such as a pressure roll. A first protrusion or end tab is located at one end of the cradle and a second protrusion or end tab is located at the other end of which at least one end tab includes a notch at an edge thereof. The notch is for selective positioning of the cradle with respect to a frame. The cradle and roll support members pivot between a first position and a second position.

Still other aspects and advantages of the present invention and methods of construction of the same will become readily apparent to those skilled in the art from the following detailed description, wherein embodiments are shown and described, simply by way of illustration. As will be realized, the invention is capable of other and different embodiments and methods of construction, and its several details are capable of modification and interchangeability in various obvious respects, all without departing from the invention. Accordingly, the drawing and description are to be regarded as illustrative in nature, and not as restrictive.

DETAILED DESCRIPTION OF THE INVENTION

While the principles and embodiments of the present invention will be described in connection with an electrostatographic reproduction apparatus, it should be understood that the present invention is not limited to that embodiment or to that application. Therefore, it should be understood that the principles of the present invention and embodiments extend to all alternatives, modifications, and equivalents thereof.

Figure 1:
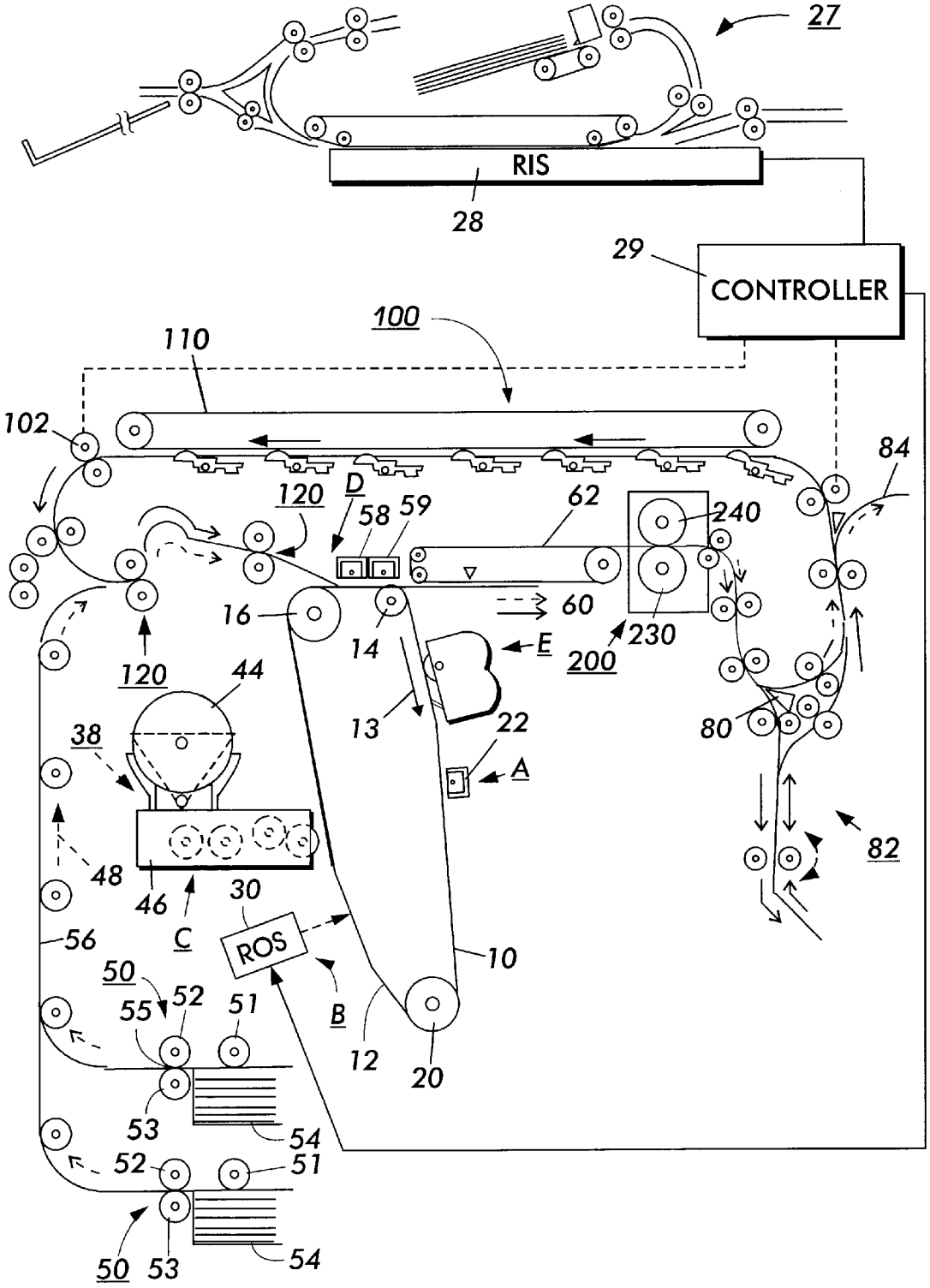
FIG. 1 is a schematic elevational view of an electrophotographic machine utilizing a cradle.

Referring to FIG. 1 of the drawings, schematically illustrated is an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

An electrophotographic printing machine may generally include a photoconductive belt 10. The photoconductive belt 10 may be made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

After the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F of the invention herein, described in detail below.

Fusing station includes a fuser assembly 200 which permanently affixes the transferred toner powder image to the copy sheet. Fuser assembly 200 may include a heated fuser roller 240 and a pressure roller 230 with the powder image on the copy sheet contacting fuser roller 240. The pressure roller is loaded against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 240. Or alternatively, release agent is stored in a presoaked web (not shown) and applied to the fuser roll 240 by pressing the web against fuser roll 240 and advancing the web at a slow speed.

The sheet then passes through fuser 200 where the image is permanently fixed or fused to the sheet. After passing through fuser 200, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser assembly 200 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
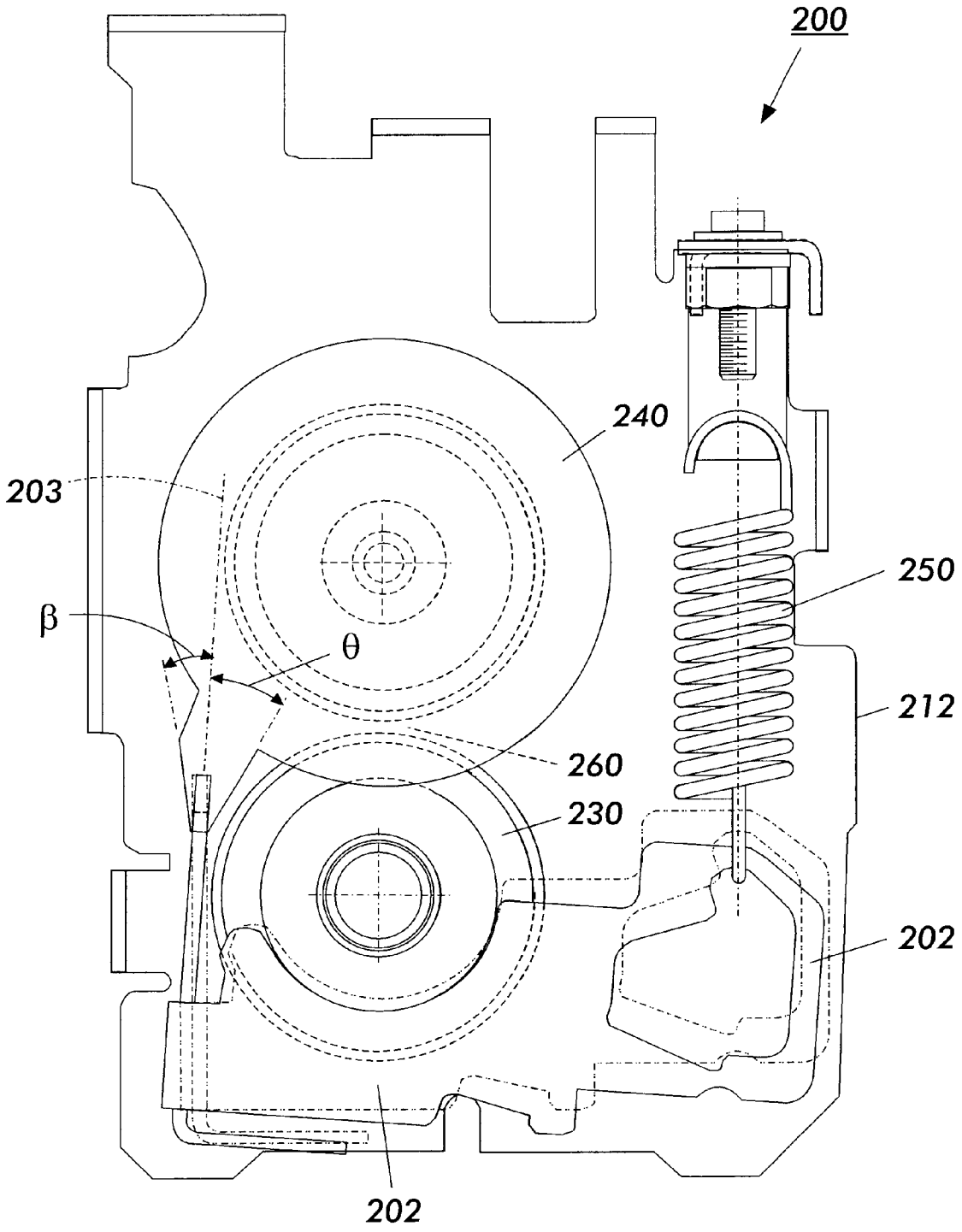
FIG. 2 is an end view of an assembly including an embodiment of the cradle.

FIG. 2 illustrates an end view of a fuser assembly 200 including a cradle 202 supported at a side frame 212 (side frame 214 not shown). The cradle 202 may be formed in one-piece member or be made of two pieces connected or formed together to make one-piece that spans between the side frames 212, 214. The cradle 202 functions to replace two separate load arms for support of a pressure roller 230 and may pivot. The cradle 202 may be formed from sheet metal. The fuser roll 240 and the pressure roll 230 may form a nip 260 therebetween.

Shown in FIG. 2 is the arcuate range of motion of the cradle 202 in the fuser assembly 200 which allows movement of the pressure roll 230 with respect to the fuser roll 240. The angular motion ($\beta+\theta$) of the cradle 202 may range up to about 120 degrees, for example, up to 60 degrees, $\beta$, from the imaginary line 203 in one direction and up to about 60 degrees, $\theta$, from the imaginary line 203 in the other direction. In an embodiment, $\beta$ ranges up to 15 degrees and $\theta$ ranges up to 30 degrees. The relative movement between the cradle 202 and the side frame 212, 214 defines a generally low friction rocking motion, and generally not a high friction sliding action.

In an embodiment, the cradle 202 may pivot about a straight line that intersects the two contact points formed between the cradle and the side frames, at the bottom surface of the end tabs 204, 206 and at the bottom of each notch 216, 218. The imaginary line 203 is a reference line from which the angular position can be measured. The notches 216, 218 of the side frames 212, 214 and the notch 220 at one end of the cradle 202 function together as a pivot and positioning system. The pivot point and imaginary line 203 are located on one side of the cradle 202 and a spring 250 is spaced apart therefrom and connected to roll support arms 224, 226 and associated with the side frames 212, 214. The end tabs 204, 206 of the cradle 202 rest on the edges of the side frames 212, 214.

Figure 3:
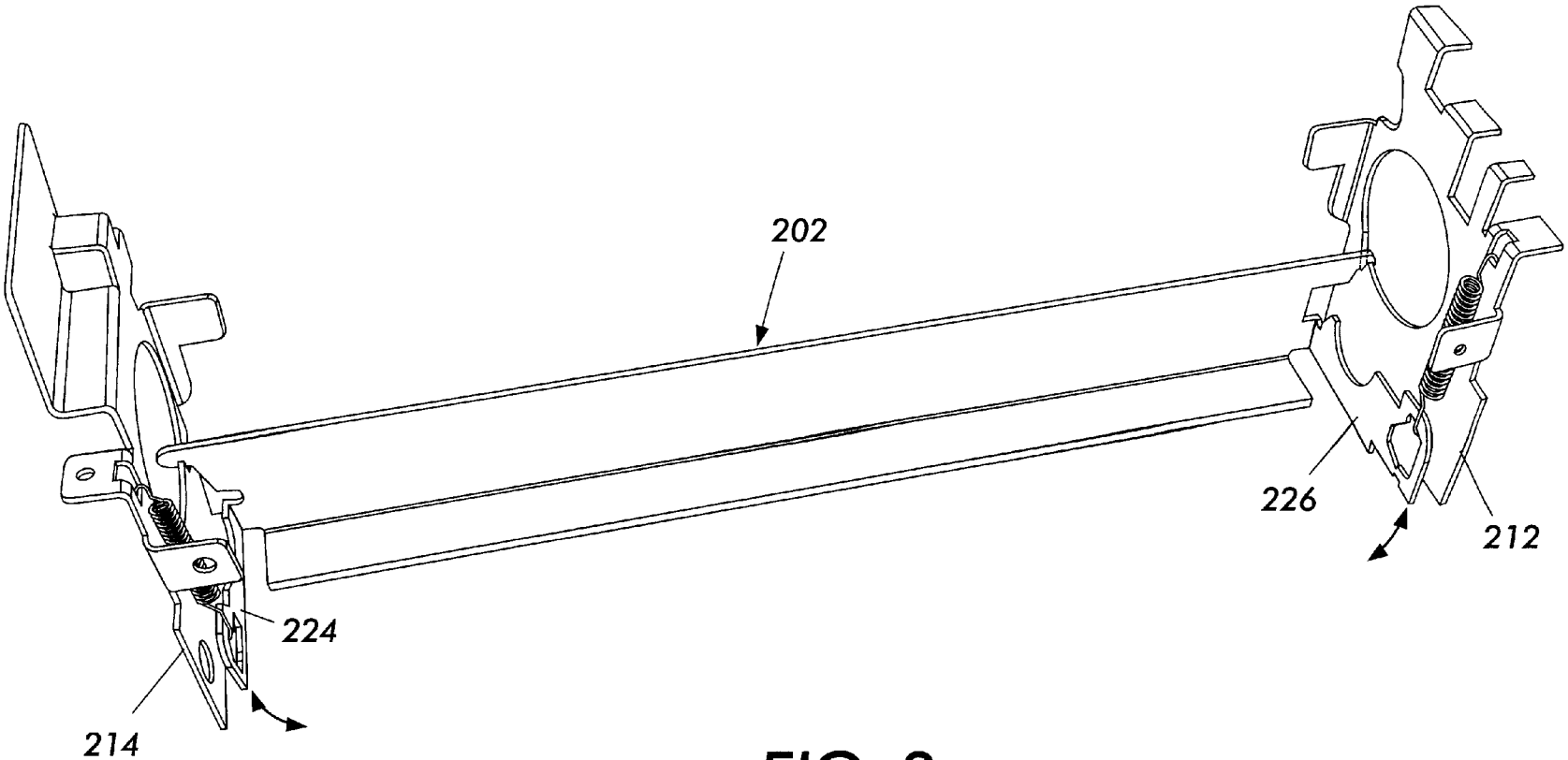
FIG. 3 is a perspective view illustrating an embodiment of the cradle supported by side frames.
Figure 4:
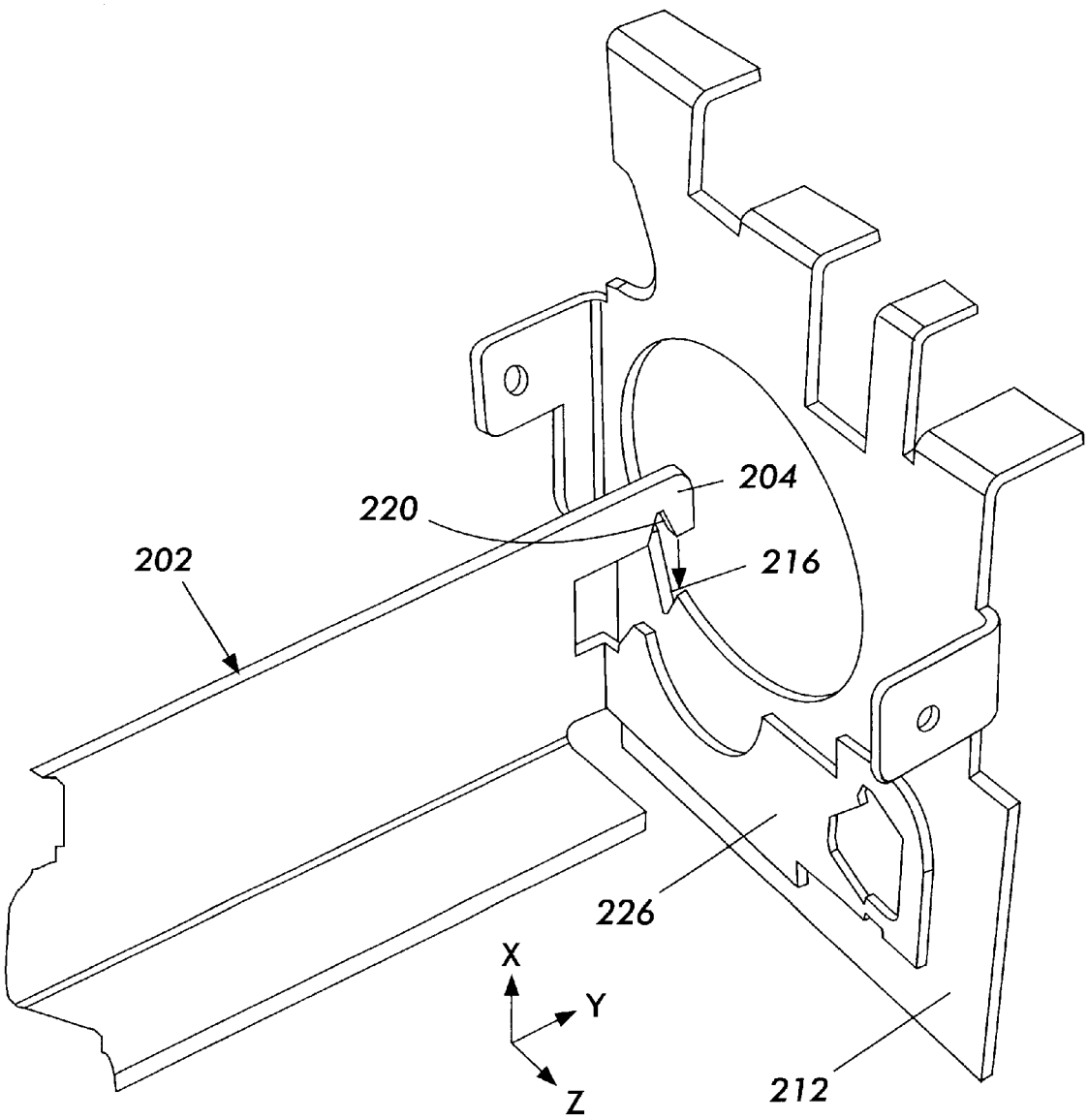
FIG. 4 illustrates a notch feature of one end tab of the cradle and an associated opening and notch features on one of the side frames.
Figure 5:
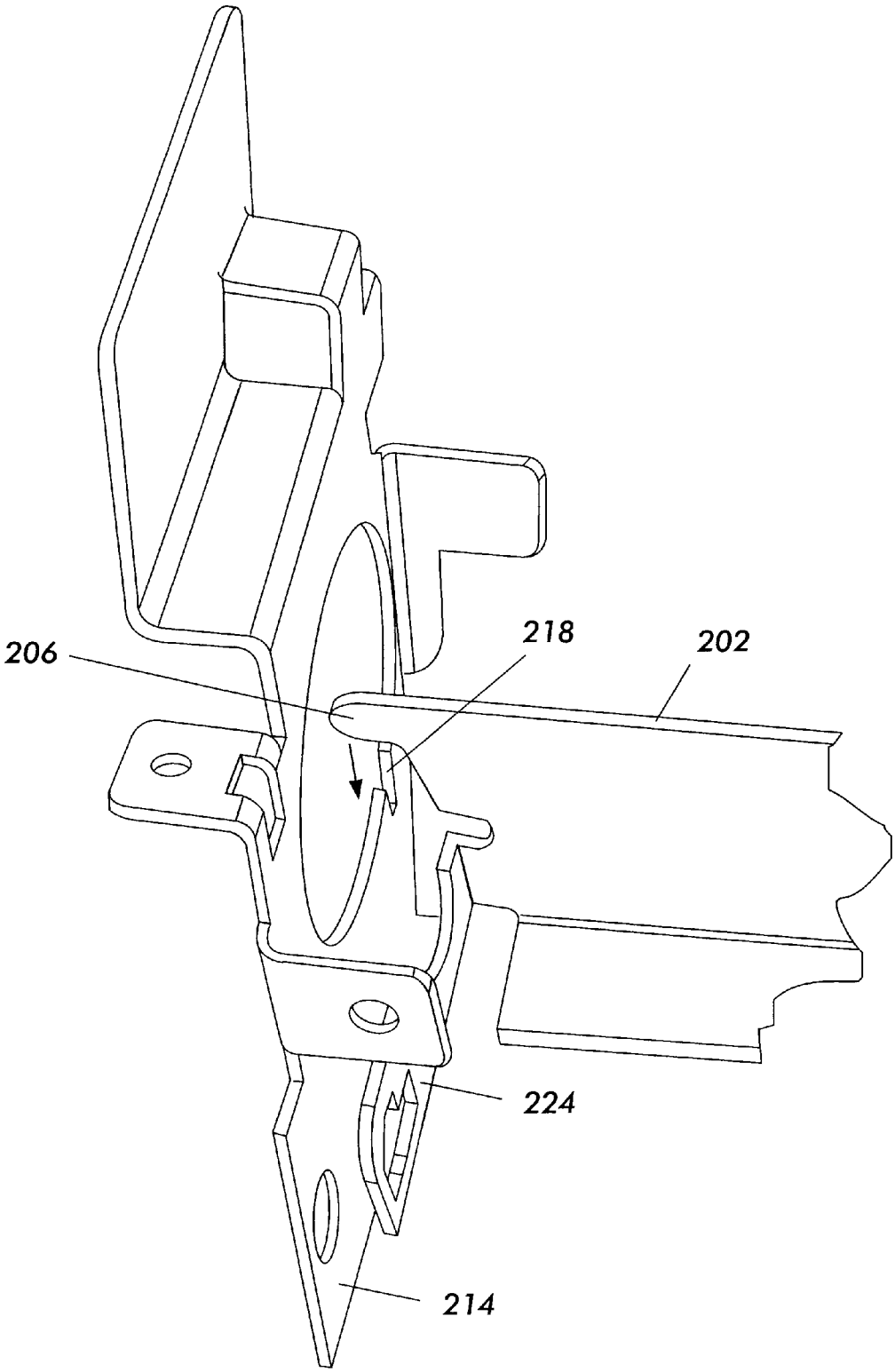
FIG. 5 illustrates an embodiment of an opposite end tab of the cradle and an associated opening and notch on the opposite side frame.

FIGS. 3, 4, and 5 are perspective views of an embodiment of the cradle 202 supported by side frames 212, 214. The cradle 202 spans the distance between the first side frame 212 and the second side frame 214 and the end tabs 204, 206 of the cradle 202 extend beyond side frames 212, 214. The cradle 202 pivots on the end tabs 204, 206 and rest on the side frames 212, 214. As a result, the load of the cradle and components, such as a roll, is applied generally coplanar with the side frames 212, 214, which eliminates the bending load associated with a pivot pin.

At least one of the side frames 212, 214 define an opening and/or a notch 216 to cooperate with the notch 220 of the end tab 204 to limit movement of the cradle 202 in the Y direction and angular rotation of the cradle 202. At least one end tab 204, 206 includes a notch to cooperate with a side frame 212, 214. Notch 220 may be located on either end tab 204, 206. In an embodiment, the notch 220 of the end tab 204 and the notch 216 of the side frame 212 may be inverted to the other and functionally cooperate with the other when the cradle 202 is supported by the side frames 212, 214. The notch 220 of the cradle 202 and the notch 216 of the side frame 212 may include a flat bottom and non-parallel sides extending from the bottom. The notches 216, 218, 220 may include a concave surface. The sides of the notches 216, 218, 220 may form a V-like shape. The notches 216, 218, 220 may include a selected shape and the cradle 202 may pivot a range defined by a selected shape formed in the side frame 212, 214. Each end tab 204, 206 may have more than one notch for selective positioning. The relative movement of the cradle 202 may be characterized by a rocking movement with respect to the side frame 212, 214.

Figure 6:
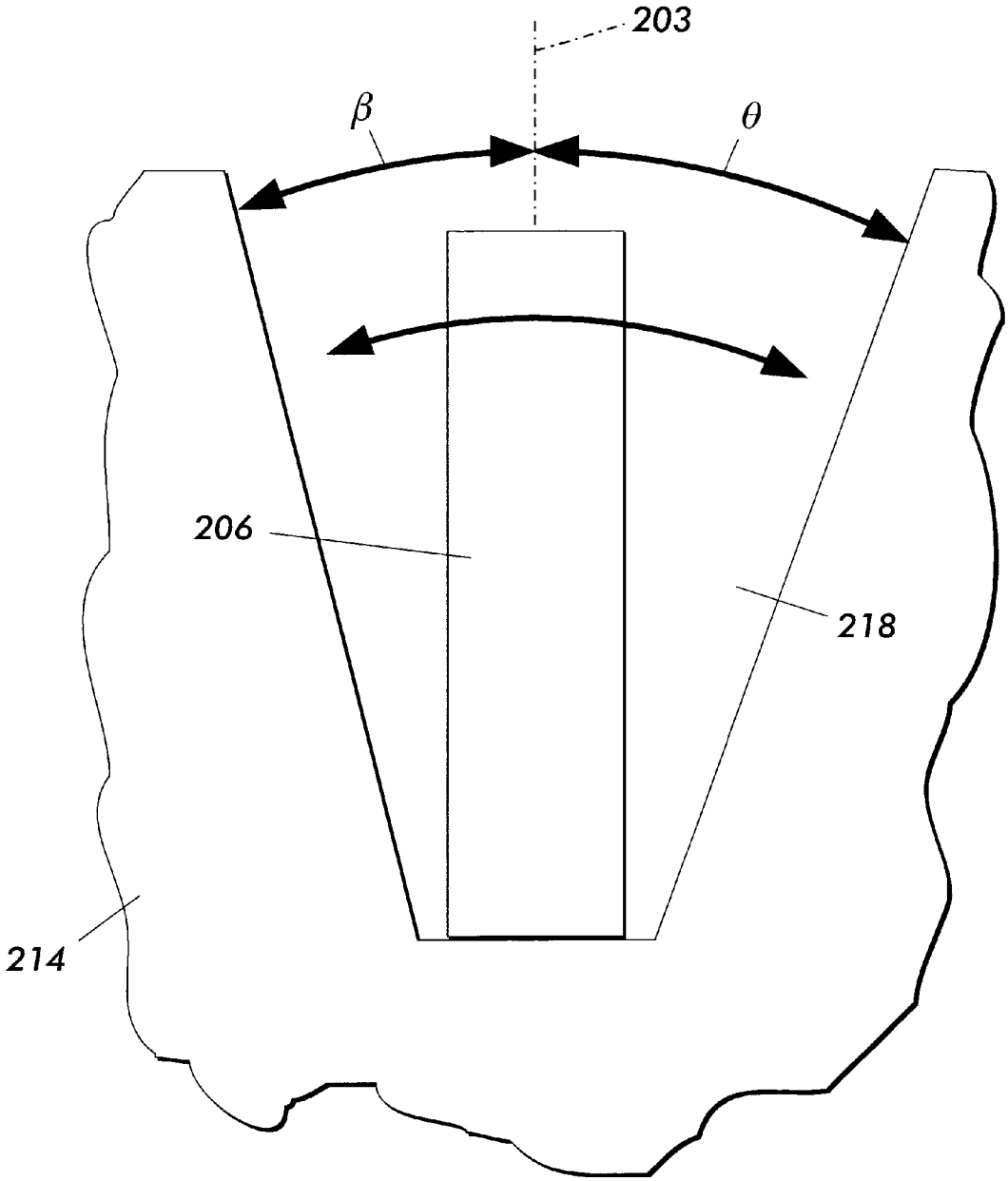
FIG. 6 illustrates an end view of FIG. 5 showing the end tab and side frame.

FIG. 4 illustrates the notch feature of end tab 204 of the cradle 202 and its associated opening 216 on the side frame 212. In embodiments, the cradle 202 may be positioned and adjusted in the X, Y, and Z directions in an amount depending on the size and position of the notches 216, 218, 220. FIG. 5 illustrates an embodiment of the end tab 206 of the cradle 202 and an opening and notch 218 on the side frame 214. FIG. 6 illustrates an end view of FIG. 5 showing embodiment of the cradle 202 and side frame 214. An end tab 206 is supported on a notch 218 having a flat bottom.

Figure 7:
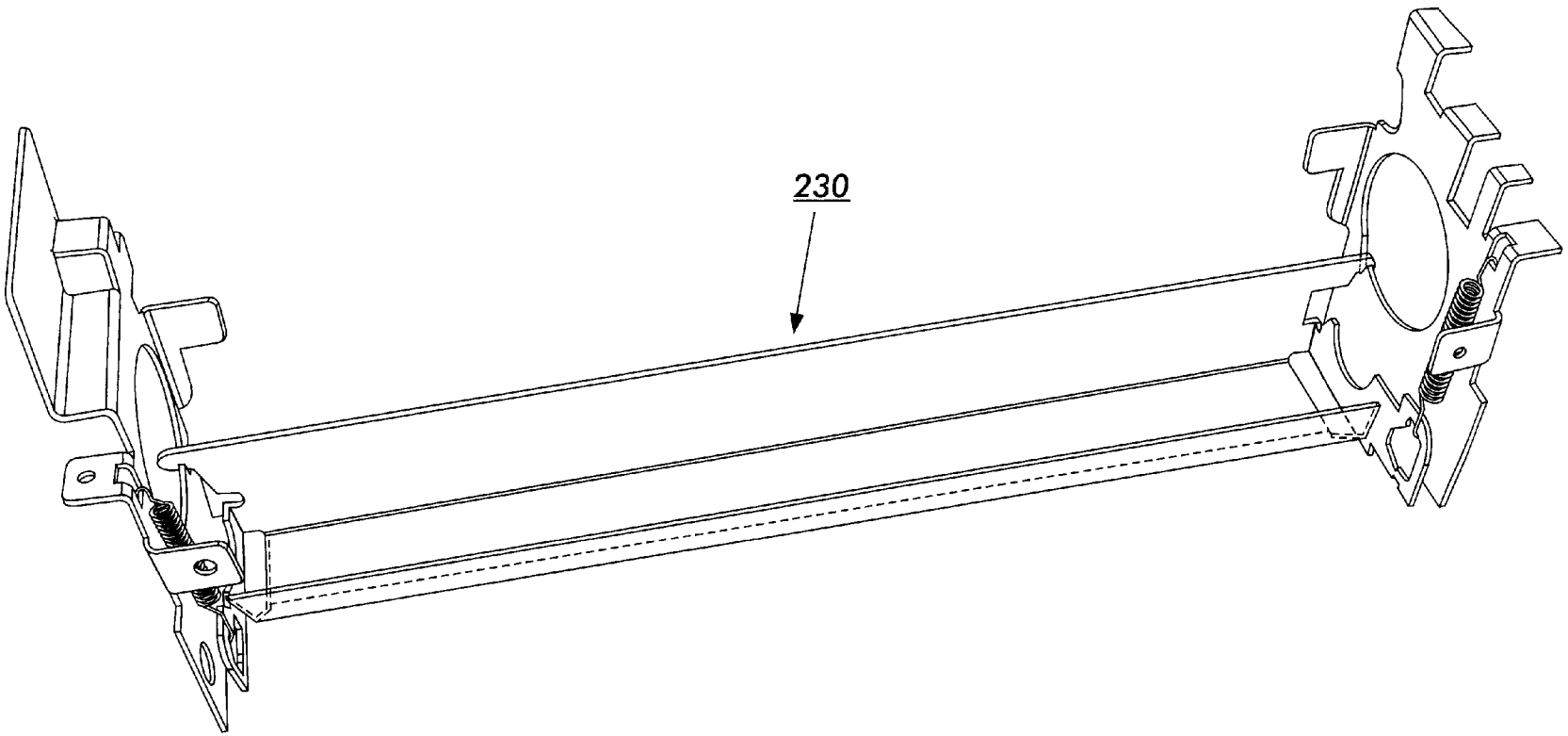
FIG. 7 illustrates an embodiment of an assembly including a cradle having a bottom shield.

Various notch shapes are envisioned including V shape, circular, triangular and concave shapes. FIG. 7 illustrates a further embodiment of a cradle 230 including a bottom shield sufficient in size to partially cover a roll such as a pressure roll.

In embodiments, a thermoplastic bottom housing may be associated with the side frames and cradle in the fusing assembly. The side frames may be made of sheet metal. The bottom cover may be made of a plastic or metal. The end tabs of the cradle may be put in place in the frame by inserting the tab first into the bearing hole and then into the notch, inserting the tabs from a side opening and into the notch, or inserting the tab into an independent notch spaced from the bearing hole. The end tabs at each end of the cradle may include one or more notches. The notches may be slots, openings, or semi-circular shapes where there is positive clearance for the cradle to pivot. The cradle may be self-aligning on the frames. The cradle and pivot features may be used in other than fusing systems where support of a member and pivot features are desired. The thickness of the metal may range from about 1 mm to about 12.7 mm, for example, about 1½ mm. The length of the cradle and roll may range from about 8 inches to about 3 feet. A flange may extend from the frame and include a notch in which to associate the cradle. The flange may extend in a cantilever fashion from the side frame.

While the invention herein has been described in the context of a black and white printing machine, it will be readily apparent that the device can be utilized in any analog or digital copying or printing machine in which a fuser is used to bond toner images to a substrate. Moreover, it is evident that many alternatives, modifications, and variations thereof will be apparent to those skilled in the art. Accordingly, it is intended to embrace all such alternatives, modifications, and variations and their equivalents.

What is claimed:

1. A roll support system in an electrophotographic apparatus comprising:

a member including a wall, the wall having a longitudinal length, a first end and a second end, a pair of roll support members formed from the wall and extending a distance from the wall, the roll support members spaced apart from one another, the wall including a first protrusion defining the first end and a second protrusion defining the second end, at least one of the first and second protrusions including a notch at an edge, the notch adapted for selective positioning of the member with respect to a frame wherein the pair of roll support members is adapted to support a roll and to pivot between a first position and a second position.

2. The roll support system of claim 1 further comprising a first side frame member and a second side frame member associated with the member and for support of the member wherein the first end of the member extends past one of the first side frame member and the second side frame member and the second end of the member extends past the other of the first side frame member and the second side frame member.

3. The roll support system of claim 2 wherein at least one of the first side frame member and the second side frame member define at least one of an opening and a notch to cooperate with the notch of the protrusion to limit movement of the member and angular rotation of the member.

4. The roll support system of claim 3 wherein the member is adapted to angularly rotate a range of up to about 45 degrees.

5. The roll support system of claim 3 wherein the member spans a distance between the first side frame member and the second side frame member and the first side frame member and the second side frame member support the member.

6. The roll support system of claim 2 wherein the notch includes a selected shape and the member is adapted to pivot a range defined by a selected shape formed in at least one of the first side frame member and the second side frame member.

7. The roll support system load arm of claim 2 wherein the relative movement of the member is characterized by a rocking movement with respect to the first side frame member and the second side frame member.

8. The roll support system of claim 1 wherein the notch includes a bottom and non-parallel sides extending from the bottom.

9. The roll support system of claim 8 wherein the sides of the notch form a V-like shape.

10. The roll support system of claim 1 wherein the notch includes a concave surface.

11. The roll support system of claim 1 wherein the roll support members are adapted to support a pressure roll.

12. The roll support system of claim 1 further including at least one spring associated with the roll support member for support.

13. The roll support system of claim 12 wherein the spring is attached to the roll support member at a location a distance from the first protrusion and the second protrusion.

14. The roll support system of claim 1 wherein the angular rotation of the member with respect to an imaginary vertical line associate with the first side frame member and the second side frame member ranges up to 45 degrees.

15. A support system for a roll in at least one of a printing and copying apparatus comprising:

a frame having a first side and a second side, each of the first side and second side having a length, width and thickness, the first side and second side each having an opening of a first selected shape; and a cradle having a length and width and including a first protrusion and a second protrusion defining a first end and a second end, at least one of the first and second protrusions including an opening of a second selected shape that is positioned opposed to the side opening such that the cradle is supported at the first and second protrusions by the first side and the second side and wherein the cradle is adapted to angularly move with respect to the frame.

16. The support system of claim 15 further comprising a fuser roll and a spring associated with the cradle, the spring for providing support at a location separated from the first and second protrusions.

17. The support system of claim 15 wherein the openings of the protrusion and the openings of the sides are inverted to the others when the cradle is supported by the frame.

18. The support system of claim 15 wherein the cradle formed from sheet metal.

19. An electrophotographic apparatus comprising:

a fuser roll;

a pressure roll associated with the fuser roll;

a frame system for supporting the fuser roll and the pressure roll, the frame system including a first side and second side, each of the first side and second side having a length, width and thickness, the first side and second side each having an opening of a selected shape; and a cradle for supporting the pressure roll between the first side and the second side of the frame system, the cradle including a wall, a length and a width, and a first protrusion and a second protrusion defining a first end and a second end of the wall, at least one of the first and second protrusions including an opening of a selected shape, wherein a plurality of pressure roll support members extending a distance from the wall;

wherein the openings of the first protrusion and the second protrusion are positioned downward and the openings of the first side and the second side are situated upward such that the first protrusion and the second protrusion are supported by the first side and the second side and wherein the cradle is adapted to angularly move with respect to the frame system.

20. The electrophotographic apparatus of claim 19 further comprising a spring associated with the cradle and frame, the spring for providing support of the cradle at a location separated from the protrusions.

21. The electrophotographic apparatus of claim 20 wherein the opening of the protrusion and the openings of the sides are inverted to the other when the cradle is supported by the frame.

22. The electrophotographic apparatus of claim 19 wherein the fuser roll and the pressure roil form a nip therebetween and wherein the cradle is one-piece and includes protrusions extending beyond the fuser roll and the pressure roll, the protrusions supported by the first side and the second side of the frame system and wherein the cradle is adapted to angularly pivot with respect to the plate members.

23. A roll support system in an apparatus comprising:

a member including a wall, the wall having a longitudinal length, a first end and a second end, a plurality of roll support members extending a distance from the wall, the plurality of roll support members spaced apart from one another, the wall including a first protrusion defining the first end and a second protrusion defining the second end, at least one of the first and second protrusions including a notch at an edge, the notch adapted for selective positioning of the member with respect to a frame wherein the plurality of roll support members are adapted to support a roll and the member is adapted to pivot between a first position and a second position.

* * * * *